US012492522B2

(12) United States Patent
Bedell

(10) Patent No.: US 12,492,522 B2
(45) Date of Patent: Dec. 9, 2025

(54) SYSTEM FOR APPLYING SNOW AND ICE REMOVAL AND TRACTION-IMPROVING PRODUCTS

(71) Applicant: Bedell Property Management, LLC, Milford, MI (US)

(72) Inventor: Michael Bedell, Milford, MI (US)

(73) Assignee: Bedell Property Management, LLC, Milford, MI (US)

( * ) Notice: Subject to any disclaimer, the term of this patent is extended or adjusted under 35 U.S.C. 154(b) by 443 days.

(21) Appl. No.: 17/827,345

(22) Filed: May 27, 2022

(65) Prior Publication Data

US 2022/0333325 A1 Oct. 20, 2022

Related U.S. Application Data

(60) Provisional application No. 63/175,501, filed on Apr. 15, 2021.

(51) Int. Cl.
*B65D 25/28* (2006.01)
*E01H 10/00* (2006.01)

(52) U.S. Cl.
CPC ..... *E01H 10/007* (2013.01); *B65D 25/2861* (2013.01)

(58) Field of Classification Search
CPC ..... E01H 10/007; B65D 25/2867; B65D 25/287; B65D 25/2873; B65D 25/26829; B65D 25/2861; B65D 25/2885; B65D 25/2853; B65D 25/2805; B65D 25/2832; B65D 25/2829; B65D 25/282; A45F 3/02
USPC ..... 239/650; 220/770; 224/257, 607–622
See application file for complete search history.

(56) References Cited

U.S. PATENT DOCUMENTS 577,118 A * 2/1897 Smith et al. ..... B65D 37/00 383/29
735,554 A * 8/1903 Miller ..... B65D 25/32 220/759
2,454,013 A * 11/1948 Scherzinger ..... B65D 33/12 383/2
2,487,491 A * 11/1949 Stone ..... B65D 25/287 206/427
3,317,232 A * 5/1967 McFaul ..... B65D 25/2829 D7/394
3,452,469 A * 7/1969 White ..... A01K 97/04 62/383
3,734,336 A * 5/1973 Rankow ..... B65D 25/32 220/592.2
3,746,066 A * 7/1973 McIntyre ..... A45C 7/0063 283/2
3,927,812 A * 12/1975 Winters ..... B65D 25/2873 220/759

(Continued)

*Primary Examiner* — Joseph A Greenlund

(57) ABSTRACT

A snow and ice removal system is disclosed. The system includes a container element and a strap element wherein both ends of the strap element are affixed to the same side of the container element. The user can place his arm through a loop in the strap and secure the strap over his shoulder. Securing the strap at two points on the same side enables the container apparatus to be carried in a horizontal position relative to the ground surface. For example, the container element may be carried in a position substantially parallel to the ground enabling the user to readily access the ice removal product. The user can easily reach in to grab the product and apply it.

10 Claims, 3 Drawing Sheets

(56) References Cited

U.S. PATENT DOCUMENTS 4,243,415 A * 1/1981 Lowe, Jr. ..... C09K 3/185 106/36
4,244,510 A * 1/1981 Snyder ..... B65D 5/14 229/117.25
4,826,077 A * 5/1989 Egy ..... B60B 39/12 238/14
5,823,136 A * 10/1998 Zarski ..... A01K 7/00 119/51.5
6,419,135 B1 * 7/2002 Sali ..... A45C 7/0063 57/210
6,991,829 B2 * 1/2006 Bergman ..... B65D 25/2817 220/769
7,337,992 B1 * 3/2008 Blatt ..... B65G 53/14 406/122
7,721,975 B2 * 5/2010 Zaharis ..... E01H 10/007 239/128
8,025,245 B2 * 9/2011 Truan ..... E01H 10/007 239/653
8,602,423 B1 * 12/2013 Alexander ..... B62B 3/165 280/30
9,724,614 B2 * 8/2017 Karsten ..... A63H 3/14
10,779,634 B1 * 9/2020 Kawamoto ..... A45F 3/04
11,427,385 B1 * 8/2022 Cutter ..... B65D 77/26
11,464,308 B2 * 10/2022 Gerber ..... A45C 11/20
11,518,590 B2 * 12/2022 Botdorf ..... A45F 3/14
11,530,842 B1 * 12/2022 Schneider ..... F24H 9/06
11,613,860 B2 * 3/2023 Firth ..... E01H 10/007 239/650
12,054,309 B2 * 8/2024 Katz ..... B65D 21/0233
D1,046,561 S * 10/2024 Munie ..... D3/216
2004/0031806 A1 * 2/2004 Jackson ..... B65D 25/287 220/754
2008/0099482 A1 * 5/2008 Luthy ..... E01C 19/2005 220/315
2008/0271235 A1 * 11/2008 Trimarche ..... G06Q 30/0601 705/26.1
2011/0259979 A1 * 10/2011 Kost ..... A01C 17/006 239/650
2012/0031919 A1 * 2/2012 Durham ..... B65D 5/68 220/772
2013/0105592 A1 * 5/2013 Kendall ..... A01C 15/006 239/650
2013/0284831 A1 * 10/2013 Darnell ..... A01C 7/02 239/650
2013/0292483 A1 * 11/2013 Kendall ..... A01C 15/006 239/650
2013/0334241 A1 * 12/2013 Abdi ..... B65D 43/0212 220/837
2015/0076202 A1 * 3/2015 Jensen ..... A45F 3/04 224/645
2016/0082585 A1 * 3/2016 Mathews, Jr. ..... B65D 25/2867 206/349
2016/0101646 A1 * 4/2016 Kiceniuk ..... B44D 3/121 206/229
2017/0129277 A1 * 5/2017 Rogowski ..... B65D 25/22
2018/0368309 A1 * 12/2018 Dubiel ..... A01C 15/02
2020/0130920 A1 * 4/2020 Schneider ..... A47J 47/18
2020/0268130 A1 * 8/2020 Kies ..... A45C 7/0077
2020/0391135 A1 * 12/2020 Reimann ..... B65D 1/18
2021/0070502 A1 * 3/2021 Shiflett, Jr. ..... B25H 3/00
2021/0394972 A1 * 12/2021 Friedman ..... A47C 7/002
2022/0041335 A1 * 2/2022 Rogers ..... B65D 81/3876
2022/0089328 A1 * 3/2022 Kisch ..... B44D 3/14
2022/0170683 A1 * 6/2022 Jacob ..... A45F 3/166
2022/0333325 A1 * 10/2022 Bedell ..... E01H 10/007
2023/0249877 A1 * 8/2023 Kisch ..... B65D 25/2829 220/754
2023/0346111 A1 * 11/2023 Macchione ..... A45F 3/02
2024/0067438 A1 * 2/2024 Waltermire ..... B65D 25/287
2024/0209579 A1 * 6/2024 Thakur ..... G05D 1/246
2024/0270450 A1 * 8/2024 Bullock ..... B65D 81/3869
2024/0271379 A1 * 8/2024 Kohn ..... E01H 10/007

* cited by examiner

SYSTEM FOR APPLYING SNOW AND ICE REMOVAL AND TRACTION-IMPROVING PRODUCTS

CROSS-REFERENCE TO RELATED APPLICATIONS

This is a Provisional U.S. Patent Application under 35 U.S.C. § 111(b).

BACKGROUND OF THE INVENTION

1. Field of the Invention

The present invention relates generally to apparatuses for carrying containers enabling users to readily access the contents. More particularly, the present invention relates to straps affixed to containers to enable users to carry and apply snow and ice removal products.

2. Description of Related Art

Snow and ice removal can be difficult in narrow areas that cannot be readily accessed by a machine. When workers carry a container filled with an ice removal product, they often use buckets or pails in five gallon or multiple liter sizes. The containers often have a wire handle enabling the worker to carry it by hand. Carrying a container with a wire handle is inefficient because one hand is dedicated to grasping the handle during movement. Further, a worker's arm can become fatigued while carrying a heavy load. Some container apparatuses utilize backpack straps to carry containers. Carrying a container on the back prevents a worker from readily accessing the contents and applying the product to the surface.

There is a need in the field for a container apparatus enabling a worker to efficiently apply an ice removal product while walking along a surface.

SUMMARY OF THE INVENTION

A snow and ice removal and prevention apparatus and system are disclosed herein. A container apparatus includes a bucket with a strap secured at two points on the same side of a bucket to create a loop. A user can place his arm through the loop in the strap and secure the strap over his shoulder. Securing the strap at two points on the same side enables the container apparatus to be carried in a horizontal position relative to a ground surface. A user can easily reach into the bucket to grab the product and apply it to the surface. The bucket can be tilted at different angles by adjusting the position of the strap on the shoulder.

These and other features and advantages will be apparent from reading of the following detailed description and review of the associated drawings. It is to be understood that both the forgoing general description and the following detailed description are explanatory and do not restrict aspects as claimed.

DETAILED DESCRIPTION OF EMBODIMENTS

The following descriptions relate principally to preferred embodiments while a few alternative embodiments may also be referenced on occasion, although many other alternative embodiments would also fall within the scope of the invention. The embodiments disclosed are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, conceptually encompassing equivalents, unless and only to the extent that a particular context clearly requires otherwise.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. Furthermore, unless explicitly dictated by the language, the term "and" may be interpreted as "or" in some instances. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more. Thus, in the context of this specification, the term "comprising" is used in an inclusive sense and thus should be understood as meaning "including, but not limited to." As used herein, the use of "may" or "may be" indicates that a modified term is appropriate, capable, or suitable for an indicated capacity, function, or usage, while considering that in some circumstances the modified term may sometimes not be appropriate, capable, or suitable.

Figure 1:
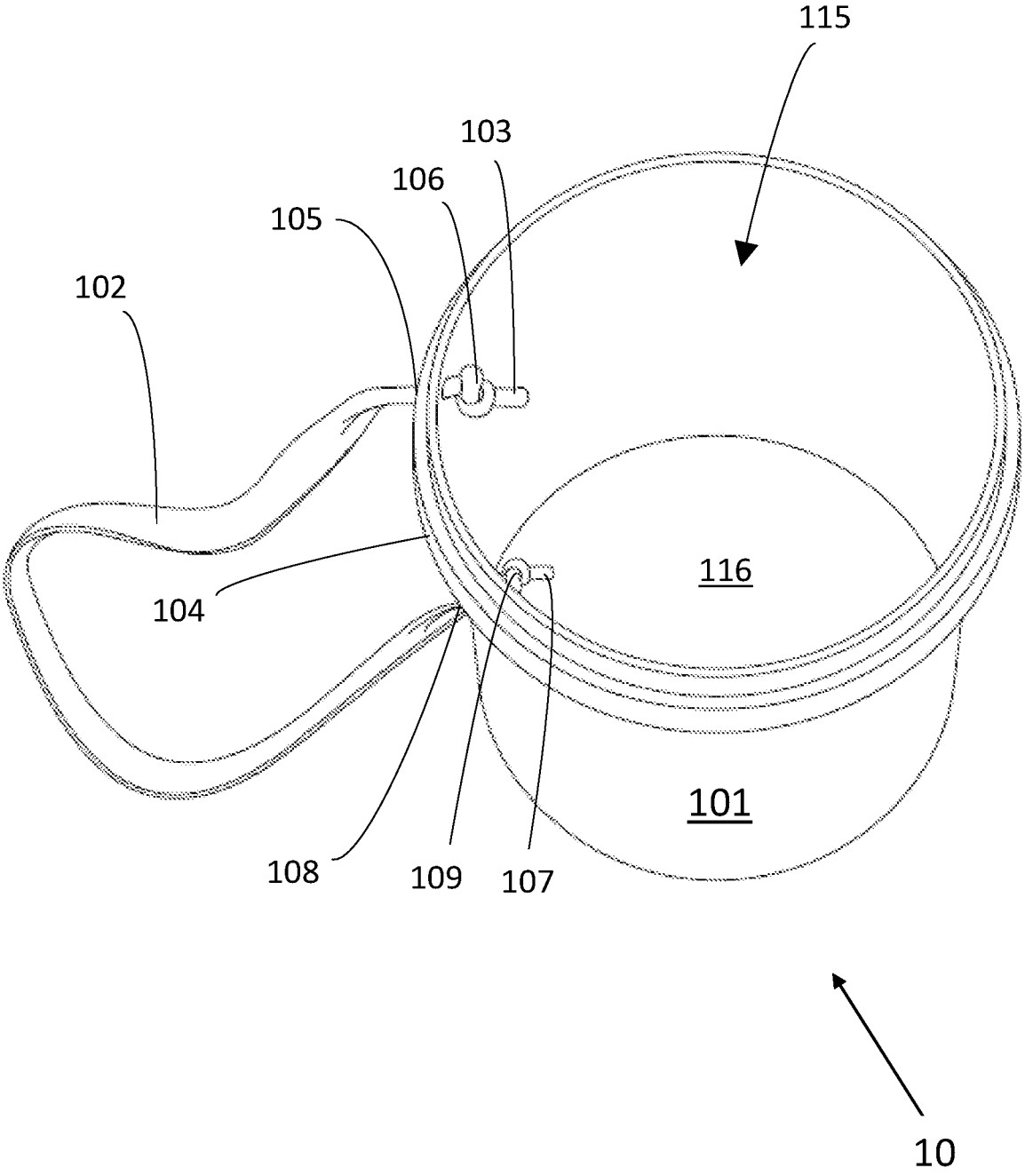
FIG. 1 illustrates a top perspective view of a container apparatus.

FIG. 1 illustrates a top perspective view of a container apparatus 10. The container apparatus 10 includes a strap 102 affixed to a container 101. The container 101 can be of any size or shape capable of holding snow removal products such as a pail, bucket, receptacle, or bin. In this example, the container 101 shown is a 5-gallon cylindrical bucket 101. A first end 103 of the strap 102 is affixed near the open top end 115 of the bucket 101. A first hole 105 can be drilled through a side 104 of the bucket 101 to enable the strap 102 to pass through. To secure the first end 103 of the strap 102 inside the bucket 101, a first knot 106 can be tied in the strap. Similarly, a second end 107 of the strap 102 is affixed near the closed bottom end 116 of the bucket 101. A second hole 108 can be drilled through the side 104 of the bucket 101 to enable the strap 102 to pass through. Similarly, a second knot 109 can be tied to secure the second end 107 of the strap 102 inside the bucket 101. The first end 103 and the second end 107 are located on the same side 104 of the bucket 101. Securing the strap 102 at two points on the same side 104 creates a loop enabling the strap 102 to be placed on a worker's (user's) shoulder. In this example, a strap is implemented but other materials can be used including rope, cords, bands, harnesses, and the like.

Figure 2:
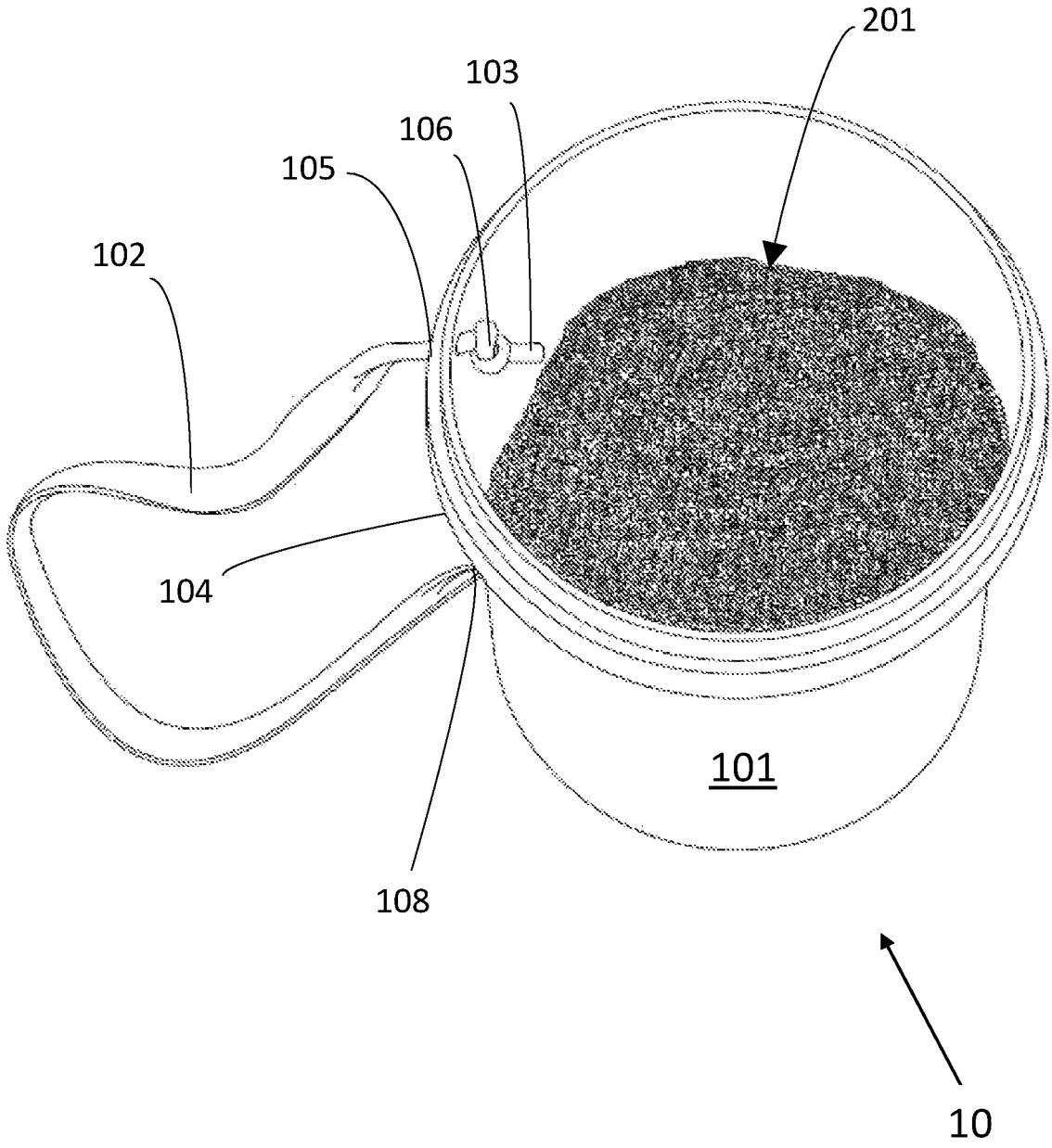
FIG. 2 illustrates a top perspective view of a container apparatus partially filled with a snow/ice removal product.

FIG. 2 illustrates a top perspective view of a container apparatus 10 partially filled with a snow/ice removal product 201. In this example, a bucket 101 is partially filled with rock salt ("halite") 201. The product 201 can be applied to a dry surface or wet surface to lower the freezing temperature of water and prevent the accumulation of ice and snow. Further, the product 201 can be applied to a surface covered in ice or snow. The bucket 101 can include other substances such as calcium chloride to facilitate ice melting or provide improved traction (e.g., sand, kitty litter). In addition to carrying substances used for snow and ice hazards, the container apparatus 10 can be used to carry other products such as water, concrete, gravel, dirt, and the like.

Figure 3:
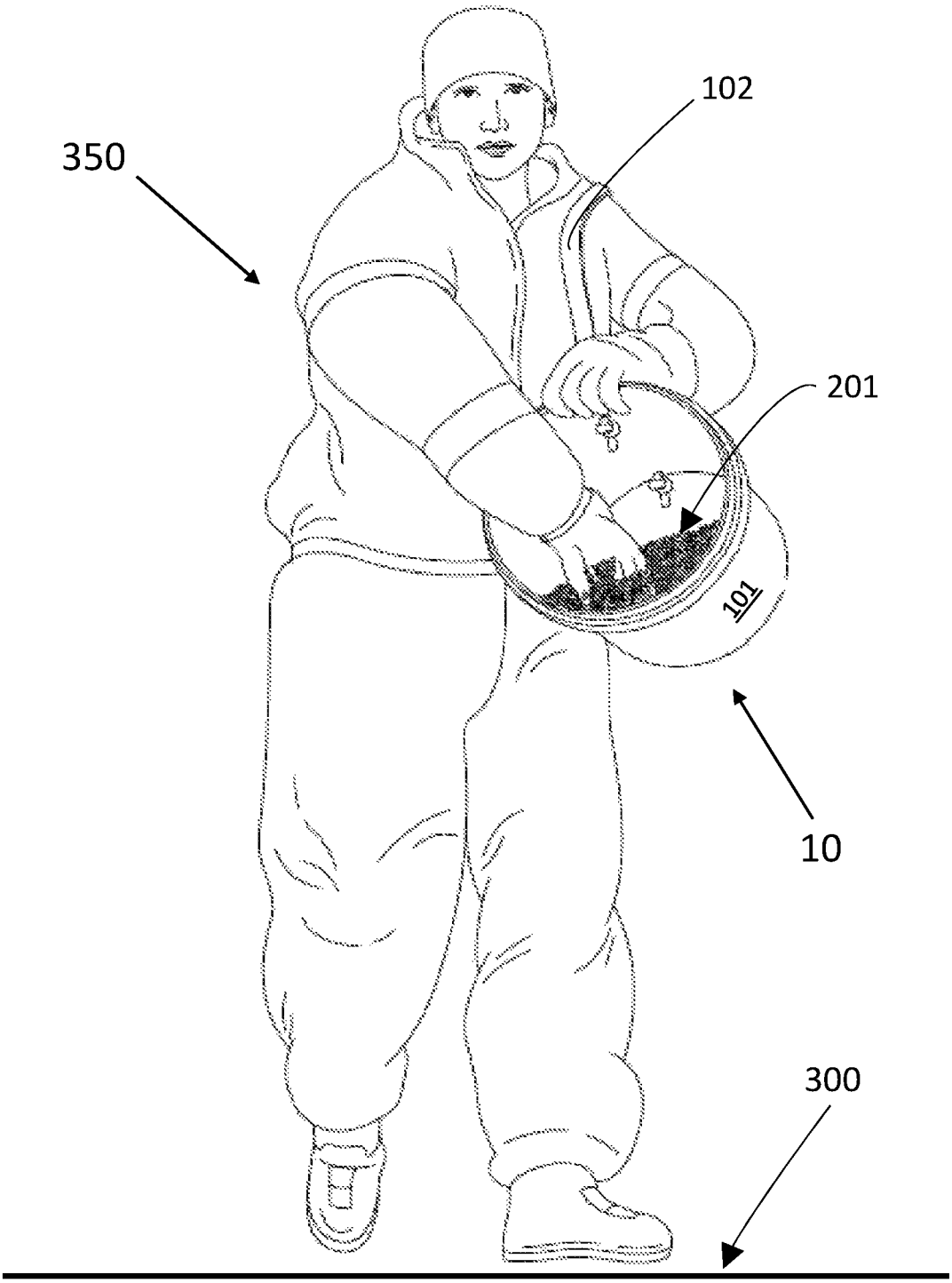
FIG. 3 illustrates a front view of a user implementing a partially filled container apparatus.

FIG. 3 illustrates a front view of a user 350 implementing the partially filled container apparatus 10. The user 350 can place his arm through a loop in the strap 102 and secure the strap over his shoulder. Securing the strap 102 at two points on the same side 104 enables the container apparatus 10 to be carried in a horizontal position relative to the ground surface 300. In this example, the bucket 101 is being carried in a position substantially parallel to the ground 300 enabling the user to readily access the ice removal product 201. The user 350 can easily reach into the bucket 101 to grab the product 201 and apply it to the surface 300. The bucket 101 can be tilted at different angles by adjusting the position of the strap 102 on the shoulder. For example, if the bucket 101 is more than half full of the product 201 the user 350 can adjust the strap 102 to tilt the bucket upward so that the open top end 115 is higher than the closed bottom end 116 relative to the surface 300. When the bucket 101 has less product 201, the user 350 can adjust the strap 102 on the shoulder to lower the top end 115 relative to the surface 300. The design of the container apparatus 10 enables a user to efficiently apply ice removal product 201 while walking along a surface 300. The container apparatus 10 is a substantial improvement over containers that must be carried in a vertical position relative to the ground.

What is claimed is:

1. A snow and ice removal system comprising:

a. a hollow container element having
   i. an open top end;
   ii. a closed bottom end;
   iii. a walled middle cavity connecting the open top end and the closed bottom end;
   iv. a rigid structure enabling the hollow container element to retain its shape while holding snow/ice removal products;

b. a first aperture and a second aperture vertically positioned, the first aperture is located closer to the open top end of the hollow container element and the second aperture is located closer to the closed bottom end of the hollow container element, the first and second apertures going from a space interior to the hollow container element to a space exterior to the hollow container element;

c. the first aperture and the second aperture both being located on a same arcuate portion of a lateral surface of the hollow container element, the arcuate portion comprising less than 180 degrees of the circumference of the hollow container element;

d. a strap element having a first end and a second end;

e. wherein the first end of the strap element passes through the first aperture from the space exterior to the hollow container element to the space interior to the hollow container element, the first end of the strap element is tied into a first knot, the first knot being located in the space interior to the hollow container element to secure the first end of the strap element in place by preventing the first end of strap element from passing back through the first aperture; and f. wherein the second end of the strap element passes through the second aperture from the space exterior to the hollow container element to the space interior to the hollow container element wherein the second end of the strap element is tied into a second knot, the second knot being located in the space interior to the hollow container element to secure the second end of the strap element in place by preventing the second end of strap element from passing back through the second aperture.

2. The system of claim 1 wherein the strap element is adjustable.

3. The system of claim 1 wherein the location of the first and second apertures on the same arcuate portion of a lateral surface of the hollow container element allows the strap element to rest on the shoulder of a user.

4. The system of claim 1 wherein the location of the apertures and position of the strap element of the hollow container element enables the distribution of both a snow/ice removal product and a traction improving product by hand.

5. The system of claim 4 wherein the snow/ice removal product is selected from the group consisting of halite and calcium chloride.

6. The system of claim 4 wherein the traction-improving product is selected from the group consisting of sand and kitty litter.

7. The system of claim 1 wherein the first and second apertures are vertically offset.

8. A snow and ice removal system comprising:

a. a hollow container element having
   i. an open top end;
   ii. a closed bottom end;
   iii. a walled middle cavity connecting the open top end and the closed bottom end;
   iv. a rigid structure enabling the hollow container element to retain its shape while holding snow/ice removal products;

b. a first aperture and a second aperture positioned vertically on a same arcuate portion of a lateral surface of the hollow container element, the arcuate portion comprising less than 180 degrees of the circumference of the hollow container element, wherein the first aperture is located closer to the open top end of the hollow container element and the second aperture located closer to the closed bottom end of the hollow container element; and c. a strap element having a first end and a second end wherein the first end and the second end of the strap element are affixed to the same arcuate portion of a lateral surface of the hollow container element.

9. The system of claim 8 wherein the vertical alignment of the apertures and the strap element enables the hollow container element to be carried at an angle on the shoulder of a user.

10. The system of claim 8 wherein the vertical positioning of the apertures and the strap element enables the distribution of both a snow/ice removal product and a traction improving product with the hand of a user opposite to the shoulder of the user holding the hollow container element.

* * * * *